US011365467B2

(12) United States Patent
Ichikawa et al.

(10) Patent No.: US 11,365,467 B2
(45) Date of Patent: Jun. 21, 2022

(54) FERRITIC STAINLESS STEEL

(71) Applicant: JFE Steel Corporation, Tokyo (JP)

(72) Inventors: Manami Ichikawa, Tokyo (JP); Tetsuyuki Nakamura, Tokyo (JP); Kunio Fukuda, Tokyo (JP); Shin Ishikawa, Tokyo (JP); Reiko Sugihara, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 16/615,883

(22) PCT Filed: Aug. 25, 2017

(86) PCT No.: PCT/JP2017/030440
§ 371 (c)(1),
(2) Date: Nov. 22, 2019

(87) PCT Pub. No.: WO2018/216236
PCT Pub. Date: Nov. 29, 2018

(65) Prior Publication Data

US 2020/0080181 A1 Mar. 12, 2020

(30) Foreign Application Priority Data

May 26, 2017 (JP) ..... JP2017-104060

(51) Int. Cl.

| | |
|---|---|
| ***C22C 38/54*** | (2006.01) |
| ***C21D 6/00*** | (2006.01) |
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |

(52) U.S. Cl.

CPC ..... *C22C 38/54* (2013.01); *C21D 6/004* (2013.01); *C21D 6/005* (2013.01); *C21D 6/007* (2013.01); *C21D 6/008* (2013.01); *C21D 8/0205* (2013.01); *C21D 8/0226* (2013.01); *C21D 8/0236* (2013.01); *C21D 8/0263* (2013.01); *C21D 9/46* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C21D 2211/005* (2013.01)

(58) Field of Classification Search

CPC ..... C22C 38/54; C22C 38/001; C22C 38/002; C22C 38/005; C22C 38/02; C22C 38/04; C22C 38/06; C22C 38/42; C22C 38/44; C22C 38/46; C22C 38/48; C22C 38/50; C22C 38/52; C21D 6/004; C21D 6/005; C21D 6/007; C21D 6/008; C21D 8/0205; C21D 8/0226; C21D 8/0236; C21D 8/0263; C21D 9/46; C21D 2211/005

USPC ..... 420/38

See application file for complete search history.

(56) References Cited

U.S. PATENT DOCUMENTS

| | | | | |
|---|---|---|---|---|
| 3,617,258 | A | 11/1971 | Terada | |
| 5,778,714 | A | 7/1998 | Katsumura et al. | |
| 7,341,690 | B2 | 3/2008 | Miyazakl et al. | |
| 7,806,993 | B2 * | 10/2010 | Miyazaki | C22C 38/04 148/325 |
| 10,272,513 | B2 | 4/2019 | Hirasawa et al. | |
| 2011/0176953 | A1 | 7/2011 | Hiraide et al. | |

(Continued)

FOREIGN PATENT DOCUMENTS

| | | | |
|---|---|---|---|
| EP | 0478790 | A1 | 4/1992 |
| EP | 2224030 | A1 | 9/2010 |

(Continued)

OTHER PUBLICATIONS

Translation JP-2015096648-A (Year: 2015).*

(Continued)

*Primary Examiner* — Brian D Walck
*Assistant Examiner* — Danielle Carda
(74) *Attorney, Agent, or Firm* — RatnerPrestia

(57) ABSTRACT

Provided is a ferritic stainless steel having excellent brazability and excellent corrosion resistance to condensed water in an environment in which the ferritic stainless steel is used for an exhaust heat recovery device or an EGR cooler.

The ferritic stainless steel has a composition containing, in mass %, C: 0.025% or less, Si: 0.01% or more and less than 0.40%, Mn: 0.05 to 1.5%, P: 0.05% or less, S: 0.01% or less, Cr: 17.0 to 30.0%, Mo: 1.10 to 3.0%, Ni: more than 0.80% and 3.0% or less, Nb: 0.20 to 0.80%, Al: 0.001 to 0.10%, and N: 0.025% or less, with the balance being Fe and incidental impurities, and satisfying the following expression (1) and expression (2):

$$C+N \leq 0.030\% \quad (1)$$

$$Cr+Mo \geq 19.0\% \quad (2)$$

where C, N, Cr, and Mo in expression (1) and expression (2) represent the contents (mass %) of the corresponding elements.

10 Claims, No Drawings

(56) References Cited

U.S. PATENT DOCUMENTS

| | | | | |
|---|---|---|---|---|
| 2014/0338796 | A1 | 11/2014 | Kim et al. | |
| 2015/0315684 | A1 | 11/2015 | Eguchi et al. | |
| 2016/0002760 | A1* | 1/2016 | Hiraide | C22C 38/002 403/272 |
| 2017/0088912 | A1* | 3/2017 | Fukuda | C22C 38/20 |
| 2017/0275723 | A1* | 9/2017 | Abe | C22C 38/005 |
| 2019/0100821 | A1 | 4/2019 | Eguchi et al. | |
| 2019/0106775 | A1* | 4/2019 | Nishida | C22C 38/26 |
| 2019/0177824 | A1* | 6/2019 | Ichikawa | C21D 8/0205 |
| 2019/0177825 | A1* | 6/2019 | Yano | B23K 1/00 |
| 2019/0226047 | A1 | 7/2019 | Abe et al. | |
| 2019/0296369 | A1* | 9/2019 | Yano | H01M 8/021 |
| 2019/0305328 | A1* | 10/2019 | Yano | C21D 1/76 |
| 2019/0368001 | A1* | 12/2019 | Kamo | C22C 38/002 |
| 2019/0376157 | A1* | 12/2019 | Kamo | C22C 38/002 |
| 2020/0002779 | A1* | 1/2020 | Yoshino | C21D 8/0263 |
| 2020/0080181 | A1 | 3/2020 | Ichikawa et al. | |
| 2020/0157646 | A1* | 5/2020 | Eguchi | C21D 6/008 |
| 2020/0216936 | A1* | 7/2020 | Kamo | C21D 8/10 |

FOREIGN PATENT DOCUMENTS

| | | | | |
|---|---|---|---|---|
| EP | 2316979 | A1 | 5/2011 | |
| EP | 2546376 | A1 | 1/2013 | |
| ER | 0547826 | A1 | 6/1993 | |
| JP | 64252 | A | 1/1989 | |
| JP | 0570899 | A | 3/1993 | |
| JP | 2001181798 | A | 7/2001 | |
| JP | 2001303202 | A | 10/2001 | |
| JP | 2002146484 | A | 5/2002 | |
| JP | 2003155543 | A | 5/2003 | |
| JP | 2009174046 | A | 8/2009 | |
| JP | 2009228036 | A | 10/2009 | |
| JP | 2010121208 | A | 6/2010 | |
| JP | 2010202916 | A | 9/2010 | |
| JP | 2012214880 | A | 11/2012 | |
| JP | 2013199661 | A | 10/2013 | |
| JP | 2015096648 | A | 5/2015 | |
| JP | 2015096648 | A * | 5/2015 | |
| JP | 2016089272 | A | 5/2016 | |
| KR | 20010061570 | A | 7/2001 | |
| WO | 2014087648 | A1 | 6/2014 | |
| WO | 2014097628 | A1 | 6/2014 | |
| WO | WO-2015141145 | A1 * | 9/2015 | C22C 38/44 |
| WO | 2016068291 | A1 | 5/2016 | |

OTHER PUBLICATIONS

Japanese Office Action for Japanese Application No. 2017-562093, dated Feb. 13, 2018, with Concise Statement of Relevance of Office Action, 4 pages.
Japanese Office Action for Japanese Application No. 2017-562093, dated Jul. 10, 2018, with Concise Statement of Relevance of Office Action, 3 pages.
Japanese Office Action for Japanese Application No. 2017-562093, dated Sep. 11, 2018, with Concise Statement of Relevance of Office Action, 4 pages.
Japanese Office Action for Japanese Application No. 2017-562093, dated Jan. 8, 2019, with Concise Statement of Relevance of Office Action, 19 pages.
Decision to Grant a Patent for Japanese Application No. 2018-218816, dated Jul. 4, 2019, with translation, 5 pages.
Extended European Search Report for European Application No. 17 911 063.0, dated Apr. 1, 2020, 10 pages.
International Search Report and Written Opinion for International Application No. PCT/JP2017/030440, dated Oct. 24, 2017, 6 pages.
Chinese Office Action with Search Report for Chinese Application No. 201780091179.8, dated Dec. 4, 2020, with Concise Statement of Relevance of Office Action, 10 pages.
Final Office Action for U.S. Appl. No. 10/512.782, dated May 24, 2010, 4 pages.
Final Office Action for U.S. Appl. No. 10/512,782, dated Aug. 18, 2008, 7 pages.
Final Office Action for U.S. Appl. No. 10/512,782, dated Oct. 15, 2009, 9 pages.
Final Office Action for U.S. Appl. No. 10/512,782, dated Dec. 26, 2007, 6 pages.
Non Final Office Action for U.S. Appl. No. 10/512,782, dated May 30, 2007, 7 pages.
Non Final Office Action for U.S. Appl. No. 10/512,782, dated Mar. 13, 2009, 7 pages.
Non Final Office Action for U.S. Appl. No. 10/512,782, dated Mar. 17, 2010, 5 pages.
Non Final Office Action for U.S. Appl. No. 16/087,486, dated May 7, 2020, 17 pages.
Notice of Allowance for U.S. Appl. No. 16/307,238, dated May 19, 2020, 9 pages.
Non Final Office Action for Application No. 16/325.577, dated Aug. 7, 2020, 28 pages.
Chinese Office Action for Chinese Application No. 201780091179.8, dated April 1, 2021, with Concise Statement of Relevance of Office Action, 5 pages.
Korean Office Action for Korean Application No. 10-2019-7034717, dated Apr. 5, 2021, with Concise Statement of Relevance of Office Action, 5 pages.
Korean Office Action for Korean Application No. 10-2019-7034717, dated Aug. 3, 2021, with Concise Statement of Relevance of Office Action, 5 pages.
Chinese Office Action for Chinese Application No. 201780091179.8, dated Jul. 2, 2021 with Concise Statement of Relevance of Office Action, 5 pages.
Non Final Office Action for U.S. Appl. No. 16/076,138, dated Oct. 28, 2020, 11 pages.
Non Final Office Action for U.S. Appl. No. 16/480,785, dated Jan. 11, 2021, 12 pages.
Final Office Action for U.S. Appl. No. 16/325,577, dated Jan. 22, 2021, 27 pages.
Non Final Office Action for U.S. Appl. No. 16/638,561, dated Apr. 13, 2021, 13 pages.
Boljanovic, V,, "Metal Shaping Processes—Casting and Molding; Particulate Processing; Deformation Processes; and Metal Removal—6.4.1 Pierce and Pilger Rolling Process," (2010), 22 pages, Industrial Press, Inc.
Non Final Office Action for U.S. Appl. No. 16/325,577, dated Aug. 2, 2021, 32 pages.
Chinese Office Action for Chinese Application No. 201780091179.8, dated Jan. 10, 2022, with Concise Statement of Relevance of Office Action, 6 pages.

* cited by examiner

FERRITIC STAINLESS STEEL

CROSS REFERENCE TO RELATED APPLICATIONS

This is the U.S. National Phase application of PCT/JP2017/030440, filed Aug. 25, 2017, which claims priority to Japanese Patent Application No. 2017-104060, filed May 26, 2017, the disclosures of these applications being incorporated herein by reference in their entireties for all purposes.

FIELD OF THE INVENTION

The present invention relates to a ferritic stainless steel used in a condensed water environment of automobile exhaust gas. More specifically, the present invention relates to a ferritic stainless steel used, for example, for an exhaust heat recovery device or an exhaust gas recirculation device, such as an EGR (Exhaust Gas Recirculation) cooler.

BACKGROUND OF THE INVENTION

In recent years environmental regulations against exhaust gas have been progressively tightened and further improvement in the fuel efficiency has been required in the automotive field. For this reason, heat exchangers, such as an exhaust heat recovery device and an EGR cooler, have been increasingly employed for automobiles.

An exhaust heat recovery device is a device for collecting and reusing exhaust gas heat and is mounted mainly on hybrid vehicles. In a system that employs an exhaust heat recovery device, warming-up of an engine is promoted by transferring exhaust gas heat to an engine coolant through a heat exchanger, thereby enhancing fuel efficiency and air heating performance.

Meanwhile, an EGR cooler is a device for recirculating exhaust gas. In a system that employs an EGR cooler, high-temperature exhaust gas on the exhaust side is cooled through a heat exchanger and the resulting cooled exhaust gas is taken in again, thereby lowering the combustion temperature of an engine and suppressing $NO_x$ generation.

A heat exchange section of such an exhaust heat recovery device or an EGR cooler is exposed to a harsh corrosive environment where condensed water forms. In the heat exchange section, exhaust gas and cooling water adjoin each other via stainless steel. When pitting arises due to corrosion, leakage of cooling water results. Accordingly, high corrosion resistance to condensed water is needed for the heat exchange section.

Patent Literature 1 discloses an austenitic stainless steel for an EGR cooler and an exhaust heat recovery device used in a case in which fuel having a high S concentration due to insufficient purification is used. Austenitic stainless steel, however, has problems of: a high cost due to a large amount of Ni contained; poor fatigue properties in a usage environment that is subjected to a restrictive force by severe vibration at a high temperature, as in peripheral parts of an exhaust manifold; and poor thermal fatigue properties at a high temperature.

Accordingly, use of steel other than austenitic stainless steel for a heat exchange section of an exhaust heat recovery device or an EGR cooler has been investigated.

Patent Literature 2, for example, discloses an automotive exhaust heat recovery device constructed by using a ferritic stainless steel. Here, pitting resistance and crevice corrosion resistance in a condensation/evaporation environment of exhaust gas are ensured by adding Mo to 18 mass % or more of Cr contained stainless steel.

Moreover, brazing is used for joining the above-mentioned heat exchange section of an EGR cooler or the like. For such members, not only enhanced corrosion resistance to condensed water, but also excellent brazability is needed.

Regarding this point, Patent Literature 3, for example, discloses a ferritic stainless steel for an EGR cooler. Here, excellent brazability and corrosion resistance against exhaust gas condensed water are ensured by containing Cr and Cu so that $Cr+2.3Cu \geq 18$ is satisfied.

Patent Literature 4 discloses a ferritic stainless steel for an exhaust heat recovery device that has, after brazing, corrosion resistance against exhaust gas condensed water. Here, in view of corrosion resistance after brazing, the ferritic stainless steel is featured by a specified cation fraction in a layer formed after brazing heat treatment.

Patent Literature

PTL 1: Japanese Unexamined Patent Application Publication No. 2013-199661

PTL 2: Japanese Unexamined Patent Application Publication No. 2009-228036

PTL 3: Japanese Unexamined Patent Application Publication No. 2010-121208

PTL 4: Japanese Unexamined Patent Application Publication No. 2012-214880

SUMMARY OF THE INVENTION

Stainless steel as in Patent Literature 2 to 4, however, exhibits unsatisfactory corrosion resistance to condensed water in some cases when a test that simulates an actual environment, in which formation and evaporation of condensed water as well as heating are repeated, is performed. Conventional techniques are thus not yet considered to have achieved desirable corrosion resistance to condensed water while ensuring satisfactory brazability.

Accordingly, an object according to aspects of the present invention is to provide a ferritic stainless steel having excellent brazability and excellent corrosion resistance to condensed water in an environment in which the ferritic stainless steel is used for an exhaust heat recovery device or an EGR cooler.

Excellent brazability here means permeation of a brazing material of 50% or more of an overlapped length of two sheets after applying 1.2 g of BNi-5 (Ni-19Cr-10Si) brazing material to the end face of either of overlapped two steel sheets and brazing the steel sheets in a vacuum atmosphere of $10^{-2}$ Pa under heating conditions of 1,170° C.×600 s.

Further, excellent corrosion resistance to condensed water here means a maximum corrosion depth of less than 100 μm after four cycles (hereinafter, also referred to as "condensed water corrosion test") of all of: full immersion of a specimen in a 200 ppm $Cl^-$+600 ppm $SO_4^{2-}$ solution with pH 8.0 and holding at 80° C. for 24 hours for immersion/evaporation tests; and holding in a furnace at 250° C. for 24 hours.

The present inventors conducted the above-described condensed water corrosion test and found that excellent corrosion resistance to condensed water can be achieved by incorporating an appropriate amount of Ni, in addition to Cr, Mo, C, and N. Further, it was found that brazability can also be ensured by adjusting Al content.

Aspects of the present invention that intend to resolve the above-mentioned problems are summarized as follows.

[1] A ferritic stainless steel having a composition containing, in mass %,

C: 0.025% or less,

Si: 0.01% or more and less than 0.40%,

Mn: 0.05 to 1.5%,

P: 0.05% or less,

S: 0.01% or less,

Cr: 17.0 to 30.0%,

Mo: 1.10 to 3.0%,

Ni: more than 0.80% and 3.0% or less,

Nb: 0.20 to 0.80%,

Al: 0.001 to 0.10%, and

N: 0.025% or less, with the balance being Fe and incidental impurities, and satisfying the following expression (1) and expression (2):

$$C+N \leq 0.030\% \quad (1)$$

$$Cr+Mo \geq 19.0\% \quad (2)$$

where C, N, Cr, and Mo in expression (1) and expression (2) represent the contents (mass %) of the corresponding elements.

[2] The ferritic stainless steel according to [1], further containing, in mass %, one or two or more selected from Cu: 0.01 to 1.0%, W: 0.01 to 1.0%, and Co: 0.01 to 1.0%.

[3] The ferritic stainless steel according to [1] or [2], further containing, in mass %, one or two or more selected from Ti: 0.01 to 0.10%, V: 0.01 to 0.50%, Zr: 0.01 to 0.30%, B: 0.0003 to 0.005%, Ca: 0.0003 to 0.003%, Mg: 0.0003 to 0.003%, and REM: 0.001 to 0.10%.

[4] The ferritic stainless steel according to any one of [1] to [3], where the ferritic stainless steel is used for an automotive exhaust heat recovery device or exhaust gas recirculation device.

According to aspects of the present invention, it is possible to provide a ferritic stainless steel having excellent brazability and excellent corrosion resistance to condensed water when the ferritic stainless steel is used for automotive parts that are exposed to a corrosive environment of condensed water, such as an exhaust heat recovery device and an EGR cooler.

DETAILED DESCRIPTION OF EMBODIMENTS OF THE INVENTION

Hereinafter, embodiments of the present invention will be described in detail.

The exhaust gas side of a heat exchange section of an exhaust heat recovery device or an EGR cooler is in an environment where condensation and evaporation of exhaust gas are repeated as in a conventional muffler. Generated condensed water is heated by exhaust gas and water contained is thus evaporated while the ionic species being concentrated and the pH being lowered, thereby corrosion of stainless steel being promoted. As fuel has diversified in recent years, exhaust gas has also diversified. Accordingly, the corrosive environment is assumed to become severe, for example, by an increase in chloride ions and/or sulfate ions that greatly affect corrosion resistance or by a pH change from neutral to weakly acidic.

In view of the above, the present inventors intensively investigated how to improve corrosion resistance to condensed water of stainless steel in an environment of exhaust gas condensed water.

As a result, incorporating an appropriate amount of Ni, in addition to Cr, Mo, C, and N that are adjusted to predetermined ranges of contents, is found to be effective for obtaining a stainless steel having excellent corrosion resistance to condensed water.

The form of corrosion in the condensed water corrosion is pitting corrosion. In accordance with aspects of the present invention, corrosion resistance to condensed water is improved by suppressing formation of pitting corrosion, decreasing the growth rate of pitting corrosion, and terminating growth of pitting corrosion. Regarding the first suppressed formation of pitting corrosion, the suppressive effect is strengthened by incorporating Cr and Mo. Regarding the second decreased growth rate of pitting corrosion, a significant decrease is achieved by incorporating an appropriate amount of Ni. Moreover, regarding the third terminated growth of pitting corrosion, the growth is more effectively terminated by further incorporating an appropriate amount of Ni, in addition to incorporation of Cr and Mo.

Further, it was found that brazability can be ensured by adjusting Al content.

The present inventors found that by different contributions from these elements to the foregoing each process, corrosion resistance to condensed water is dramatically improved while ensuring brazability, thereby accomplishing aspects of the present invention.

A ferritic stainless steel according to aspects of the present invention based on the above findings is featured by having a composition containing, in mass %, C: 0.025% or less, Si: 0.01% or more and less than 0.40%, Mn: 0.05 to 1.5%, P: 0.05% or less, S: 0.01% or less, Cr: 17.0 to 30.0%, Mo: 1.10 to 3.0%, Ni: more than 0.80% and 3.0% or less, Nb: 0.20 to 0.80%, Al: 0.001 to 0.10%, and N: 0.025% or less, with the balance being Fe and incidental impurities, and satisfying the following expression (1) and expression (2):

$$C+N \leq 0.030\% \quad (1)$$

$$Cr+Mo \geq 19.0\% \quad (2)$$

where C, N, Cr, and Mo in expression (1) and expression (2) represent the contents (mass %) of the corresponding elements. The ferritic stainless steel has excellent brazability and excellent corrosion resistance to condensed water when the ferritic stainless steel is used for automotive parts that are exposed to a corrosive environment of condensed water, such as an exhaust heat recovery device and an EGR cooler.

Hereinafter, the chemical composition of the ferritic stainless steel according to aspects of the present invention will be first described. Herein, the sign "%" that represents the content of each element means mass % unless otherwise stated.

C: 0.025% or Less

C is an incidentally contained element in steel. Increasing the C content improves strength, whereas decreasing the C content improves workability. To increase strength, 0.001% or more C is preferably contained. Meanwhile, when C content exceeds 0.025%, workability deteriorates considerably. In addition, Cr carbide is precipitated, and consequently, corrosion resistance to condensed water tends to deteriorate due to local Cr depletion. Accordingly, C content is set to 0.025% or less. C content is preferably 0.020% or less, more preferably 0.015% or less, and further preferably 0.010% or less. Meanwhile, C content is more preferably 0.003% or more and further preferably 0.004% or more.

Si: 0.01% or More and Less Than 0.40%

Si has a deoxidizing action, and the effect is obtained by Si content of 0.01% or more. Meanwhile, when 0.40% or more of Si is contained, pickling properties during manufacture deteriorate. Accordingly, Si content is set to 0.01% or more and less than 0.40%. Si content is preferably 0.05% or more, more preferably 0.10% or more, further preferably 0.20% or more, and still further preferably 0.30% or more.

Mn: 0.05 to 1.5%

Mn has a deoxidizing action, and the effect is obtained by Mn content of 0.05% or more. Meanwhile, Mn content exceeding 1.5% deteriorates workability due to solid solution strengthening. In addition, Mn content exceeding 1.5% promotes precipitation of MnS, which acts as a starting point of corrosion, thereby deteriorating corrosion resistance to condensed water. Accordingly, Mn content is set to the range of 0.05 to 1.5%. Mn content is preferably 0.10% or more. Meanwhile, Mn content is preferably 0.50% or less and more preferably 0.30% or less.

P: 0.05% or Less

P is an inevitably contained element in steel. P content exceeding 0.05% deteriorates weldability and easily causes intergranular corrosion. Accordingly, P content is limited to 0.05% or less. P content is preferably 0.04% or less and further preferably 0.03% or less.

S: 0.01% or Less

S is an inevitably contained element in steel. S content exceeding 0.01% promotes precipitation of MnS and deteriorates corrosion resistance to condensed water. Accordingly, S content is set to 0.01% or less. S content is preferably 0.008% or less and more preferably 0.005% or less.

Cr: 17.0 to 30.0%

Cr is an important element for ensuring corrosion resistance to condensed water. When Cr content is less than 17.0%, corrosion resistance to condensed water is not achieved satisfactorily. Meanwhile, when more than 30.0% of Cr is contained, workability and/or manufacturability deteriorate. Accordingly, Cr content is set to the range of 17.0 to 30.0%. Cr content is preferably 18.0% or more, more preferably 19.0% or more, and further preferably 20.5% or more. Meanwhile, Cr content is preferably 24.0% or less, more preferably 23.0% or less, and further preferably 22.0% or less.

Mo: 1.10 to 3.0%

Mo has an effect of stabilizing a passivation film of stainless steel and thus improving corrosion resistance to condensed water. In an exhaust heat recovery device or an EGR cooler, Mo has an effect of preventing corrosion of inner surfaces due to condensed water and corrosion of outer surfaces due to a snow melting agent or the like. Further, Mo has an effect of enhancing thermal fatigue properties and thus is a particularly suitable element when stainless steel is used for an EGR cooler that is placed immediately under an exhaust manifold. These effects are obtained by Mo content of 1.10% or more. Meanwhile, Mo is an expensive element and thus increases a cost. Moreover, when Mo content exceeds 3.0%, workability deteriorates. Accordingly, Mo content is set to the range of 1.10 to 3.0%. Mo content is preferably 1.50% or more and more preferably 1.60% or more. Meanwhile, Mo content is preferably 2.50% or less and more preferably 2.00% or less.

Ni: More Than 0.80% and 3.0% or Less

Ni is an important element for improving corrosion resistance to condensed water in accordance with aspects of the present invention. The effect is obtained by Ni content of more than 0.80%. Meanwhile, when Ni content exceeds 3.0%, susceptibility to stress corrosion cracking increases. Accordingly, Ni content is set to the range of more than 0.80% and 3.0% or less. Ni content is preferably more than 1.00%, more preferably 1.20% or more, and further preferably 1.50% or more. Meanwhile, Ni content is preferably 2.50% or less. When Ni content is 1.20% or more, particularly excellent corrosion resistance to condensed water is achieved.

Nb: 0.20 to 0.80%

Nb is an element that is preferentially combined with C and N, thereby suppressing deterioration of corrosion resistance to condensed water due to precipitation of Cr carbonitride. Nb also has an effect of increasing high-temperature strength, thereby enhancing thermal fatigue properties. These effects are obtained by Nb content of 0.20% or more. Meanwhile, when Nb content exceeds 0.80%, toughness deteriorates. Accordingly, Nb content is set to the range of 0.20 to 0.80%. Nb content is preferably 0.25% or more. Meanwhile, Nb content is preferably 0.60% or less, more preferably 0.50% or less, and further preferably 0.40% or less.

Al: 0.001 to 0.10%

Al is a useful element for deoxidation, and the effect is obtained by Al content of 0.001% or more. Meanwhile, Al content exceeding 0.10% deteriorates brazability. Al content is thus set to 0.10% or less. Accordingly, Al content is set to 0.001 to 0.10%. Al content is preferably 0.050% or less, more preferably 0.025% or less, further preferably 0.015% or less, still further preferably 0.010% or less, and particularly preferably 0.008% or less.

N: 0.025% or Less

N is an incidentally contained element in steel in a similar manner to C and has an effect of increasing strength of steel due to solid solution strengthening. Such an effect is obtained by N content of 0.001% or more. Meanwhile, when N is contained by more than 0.025% and is precipitated as Cr nitride, corrosion resistance to condensed water deteriorates. Accordingly, N content is set to 0.025% or less. N content is preferably 0.020% or less, more preferably 0.015% or less, and further preferably 0.010% or less. Meanwhile, N content is preferably 0.001% or more, more preferably 0.003% or more, and further preferably 0.005% or more.

$$C+N: 0.030\% \text{ or Less} \quad (1)$$

where C and N in expression (1) represent the contents (mass %) of the respective elements.

Excessive contents of C and N deteriorate corrosion resistance to condensed water and workability. Accordingly, C content and N content are set to the above-mentioned respective ranges, and further, C+N (the sum of C content and N content) is set to 0.030% or less. C+N is preferably 0.025% or less and more preferably 0.020% or less.

$$Cr+Mo: 19.0\% \text{ or More} \quad (2)$$

where Cr and Mo in expression (2) represent the contents (mass %) of the respective elements.

As described above, in accordance with aspects of the present invention, Cr and Mo are set to the respective predetermined contents to improve corrosion resistance to condensed water. Moreover, the present inventors found, as a result of vigorous investigation, that when Cr+Mo (the sum of Cr content and Mo content) is less than 19.0%, desired corrosion resistance to condensed water is not achieved. Accordingly, in accordance with aspects of the present invention, Cr content and Mo content are set to the above-mentioned respective ranges, and further, Cr+Mo is set to 19.0% or more. More preferably, Cr+Mo is set to 21.0% or more.

In the ferritic stainless steel according to aspects of the present invention, the balance is Fe and incidental impurities.

In addition to the above-described components, the ferritic stainless steel according to aspects of the present invention may further contain one or two or more selected from Cu, W, and Co in the following ranges.

Cu: 0.01 to 1.0%

Cu is an element that has an effect of improving corrosion resistance to condensed water. The effect is obtained by Cu content of 0.01% or more. Meanwhile, when Cu content exceeds 1.0%, hot workability deteriorates in some cases. Accordingly, if contained, Cu content is preferably set to the range of 0.01 to 1.0%. Cu content is more preferably 0.05% or more. Meanwhile, Cu content is more preferably 0.50% or less.

W: 0.01 to 1.0%

W has an effect of improving corrosion resistance to condensed water in a similar manner to Mo. The effect is obtained by W content of 0.01% or more. Meanwhile, when W content exceeds 1.0%, manufacturability deteriorates in some cases. Accordingly, if contained, W content is preferably set to 0.01 to 1.0%. More preferably, W content is 0.50% or less.

Co: 0.01 to 1.0%

Co is an element that improves corrosion resistance to condensed water and toughness. The effect is obtained by Co content of 0.01% or more. Meanwhile, when Co content exceeds 1.0%, manufacturability deteriorates in some cases. Accordingly, if contained, Co content is preferably set to 0.01 to 1.0%. Co content is more preferably 0.02% or more and further preferably 0.04% or more. Meanwhile, Co content is more preferably 0.50% or less and further preferably 0.20% or less.

The ferritic stainless steel according to aspects of the present invention may further contain one or two or more selected from Ti, V, Zr, B, Ca, Mg, and REM in the following ranges.

Ti: 0.01 to 0.10%

Ti is combined with C and N contained in steel and has an effect of preventing sensitization. The effect is obtained by Ti content of 0.01% or more. Meanwhile, Ti is an element active against oxygen. Ti content exceeding 0.10% deteriorates brazability in some cases through formation of a dense and continuous Ti oxide layer on a steel surface during brazing. Accordingly, Ti content is preferably set to 0.01 to 0.10%. Ti content is more preferably 0.02% or more and further preferably 0.03% or more. Meanwhile, Ti content is more preferably 0.05% or less and further preferably 0.04% or less.

V: 0.01 to 0.50%

V is combined with C and N contained in steel in a similar manner to Ti and has an effect of preventing sensitization. The effect is obtained by V content of 0.01% or more. Meanwhile, when V content exceeds 0.50%, workability deteriorates in some cases. Accordingly, if contained, V content is preferably set to the range of 0.01 to 0.50%. V content is more preferably 0.03% or more and further preferably 0.05% or more. Meanwhile, V content is more preferably 0.40% or less and further preferably 0.25% or less.

Zr: 0.01 to 0.30%

Zr is combined with C and N and has an effect of suppressing sensitization. The effect is obtained by Zr content of 0.01% or more. Meanwhile, when Zr content exceeds 0.30%, workability deteriorates. In addition, Zr is an extremely expensive element and thus increases a cost in some cases. Accordingly, if contained, Zr content is preferably set to 0.01 to 0.30%. Zr content is more preferably 0.05% or more. Meanwhile, Zr content is more preferably 0.20% or less.

B: 0.0003 to 0.005%

B is an element that improves secondary working embrittlement. The effect is obtained by B content of 0.0003% or more. Meanwhile, when B content exceeds 0.005%, ductility deteriorates due to solid solution strengthening in some cases. Accordingly, if contained, B content is preferably set to the range of 0.0003 to 0.005%. B content is more preferably 0.0005% or more. Meanwhile, B content is more preferably 0.0030% or less.

Ca: 0.0003 to 0.003%

Ca improves penetration properties in a weld, thereby enhancing weldability. The effect is obtained by Ca content of 0.0003% or more. Meanwhile, when Ca content exceeds 0.003%, Ca is combined with S to form CaS, thereby deteriorating corrosion resistance to condensed water in some cases. Accordingly, if contained, Ca content is preferably set to the range of 0.0003 to 0.003%. Ca content is more preferably 0.0005% or more. Meanwhile, Ca content is more preferably 0.0020% or less.

Mg: 0.0003 to 0.003%

Mg is an element that is useful for refining due to the deoxidizing effect and the like and is also useful for improving workability and toughness through refinement of the microstructure. Mg may be contained, as necessary, at 0.003% or less. If contained, Mg content is preferably set to 0.0003% or more at which stable effects are obtained. That is, if contained, Mg content is preferably set to 0.0003 to 0.003%. Mg content is more preferably 0.0020% or less.

REM: 0.001 to 0.10%

REM (rare earth metal) improves oxidation resistance and thus suppresses formation of oxide scale, thereby suppressing formation of Cr depletion regions immediately under the temper color of a weld. The effect is obtained by REM content of 0.001% or more. Meanwhile, when REM content exceeds 0.10%, manufacturability, such as manufacturability in the pickling process, deteriorates and further, a cost increases. Accordingly, if contained, REM content is preferably set to 0.001 to 0.10%.

Next, a manufacturing method for the ferritic stainless steel according to aspects of the present invention will be described.

A manufacturing method for the stainless steel according to aspects of the present invention is not particularly limited and any common manufacturing method for ferritic stainless steel may suitably be employed. For example, the stainless steel may be manufactured through manufacturing steps of: preparing steel having the above-described chemical composition according to aspects of the present invention by refining steel in a known melting furnace, such as a converter or an electric furnace, or further by secondary refining, such as ladle refining or vacuum refining; forming into a slab by a continuous casting method or an ingot casting-slabbing method; and subsequently forming into a cold-rolled annealed sheet through each step of hot rolling, hot-rolled sheet annealing, pickling, cold rolling, finish annealing, pickling, and the like. The above-mentioned cold rolling may be preformed once or two or more times via intermediate annealing. Moreover, each step of cold rolling, finish annealing, and pickling may be repeated. Further, hot-rolled sheet annealing may be omitted. When adjustment of the surface gloss or roughness of a steel sheet is required, skin-pass rolling may be performed after cold rolling or finish annealing.

Preferable manufacturing conditions in the above-described manufacturing method will be described.

In the steelmaking process for refining steel, steel melted in a converter, an electric furnace, or the like is preferably subjected to secondary refining through the VOD process or the like to prepare steel containing the above-described essential components and components added as necessary. The refined molten steel may be formed into a steel material by any known method and preferably by a continuous casting method in view of productivity and quality. Subsequently, the steel material is heated to preferably 1,050° C. to 1,250° C. and hot-rolled into a hot-rolled sheet having a desired thickness. Here, the steel material may certainly be hot-worked into a material other than sheets. The hot-rolled sheet is then preferably finished to a hot-rolled product by undergoing continuous annealing at a temperature of 900° C. to 1,150° C. as necessary, followed by descaling through pickling or the like. As necessary, scale may be removed by shot blasting before pickling.

Further, the above-described hot-rolled annealed sheet may be formed into a cold-rolled product through a step of cold rolling and so forth. In this case, cold rolling may be performed once or two or more times via intermediate annealing in view of productivity and required quality. The total reduction ratio in cold rolling that is performed once or two or more times is preferably 60% or more and more preferably 70% or more. After that, the cold-rolled steel sheet is preferably finished to a cold-rolled product by undergoing continuous annealing (finish annealing) at a temperature of preferably 900° C. to 1,150° C. and further preferably 950° C. to 1,150° C., followed by pickling. Here, the continuous annealing may be performed as bright annealing, and pickling may be omitted. Further, the shape, surface roughness, and material properties of the steel sheet may be adjusted depending on applications through skin-pass rolling or the like after finish annealing.

The above-described ferritic stainless steel according to aspects of the present invention is suitably used for an automotive exhaust heat recovery device and exhaust gas recirculation device, such as an EGR cooler.

EXAMPLES

Hereinafter, the present invention will be described in further detail with reference to the Examples.

Steel each having the chemical composition of No. 1 to 43 shown in Tables 1 and 2 was prepared through refining in a vacuum melting furnace, heated at 1,100° C. to 1,200° C. for 1 hour, followed by hot rolling to manufacture a 4.0 mm-thick hot-rolled sheet. The hot-rolled sheet was subjected to hot-rolled sheet annealing at 950° C. to 1,100° C., followed by descaling and cold rolling into the thickness of 1.0 mm. The cold-rolled sheet was subjected to finish annealing at 950° C. to 1,100° C. The obtained cold-rolled annealed sheet was finished polishing with #600 emery paper, degreased with acetone, and subjected to tests.

<Corrosion Resistance to Condensed Water>

Corrosion resistance to condensed water was evaluated by a cycle test that simulates an actual environment. Each cold-rolled annealed sheet was cut into a size of 25 mm×100 mm and subjected to the test. With reference to an example of analysis of condensed water that was taken from an exhaust heat recovery device of an actual vehicle, only chloride ion and sulfate ion, which particularly contribute to corrosion, were used for a test solution. A solution of 200 ppm $Cl^-$+600 ppm $SO_4^{2-}$ was prepared by using hydrochloric acid and sulfuric acid as reagents and then adjusted to pH 8.0 by using ammonia water. The specimen was immersed in the solution controlled at a constant temperature of 80° C., and the immersion solution in which the specimen remained immersed was evaporated in 24 hours. This step was performed five times. Subsequently, the specimen was placed in a furnace at 250° C. and heated and held for 24 hours. This procedure was set as one cycle, and four cycles were performed in total. After the test, corrosion products were removed, and the corrosion depth was measured by using a 3D microscope. Evaluation was made for the maximum corrosion depth of less than 80 μm as ⊙ (satisfactory, particularly excellent), the maximum corrosion depth of 80 μm or more and less than 100 μm as ○ (satisfactory), and the maximum corrosion depth of 100 μm or more as × (failed).

<Brazability>

Brazability was evaluated as permeation of a brazing material into a gap. A 30 mm-square sheet and a 25 mm×30 mm sheet were cut out from each cold-rolled annealed sheet, and the two sheets were overlapped and held by a clamp with a constant torque force (170 kgf). To the end face of either sheet, 1.2 g of BNi-5 (Ni-19Cr-10Si) brazing material was applied and brazing was performed under a vacuum atmosphere of $10^{-2}$ Pa.

As a temperature pattern for heat treatment, a procedure of: rising temperature at 10° C./s; soaking time 1 (the step for making the entire temperature uniform): 1,060° C.×1,800 s; rising temperature at 10° C./s; and soaking time 2 (the step of actually performing brazing at a temperature equal to or higher than the melting point of the brazing material): 1,170° C.×600 s was performed in this order. Subsequently, the furnace was cooled and purged with outer air (the atmosphere) when the temperature reached 200° C. After brazing, permeation of the brazing material into between the sheets was visually observed from the side surface portions of the overlapped sheets and evaluated in accordance with the following criteria. Permeation of the brazing material of 50% or more of the overlapped length of the two sheets is evaluated as ○ (satisfactory), and permeation of the brazing material of less than 50% of the overlapped length of the two sheets is evaluated as × (failed).

TABLE 1

| Steel No. | Chemical composition (mass %) C | Si | Mn | P | S | Cr | Mo | Ni | Nb | Al | N | C + N | Cr + Mo | Other elements | Corrosion Resistance to Condensed Water | Brazability | Note |
|---|---|---|---|---|---|---|---|---|---|---|---|---|---|---|---|---|---|
| 1 | 0.004 | 0.33 | 0.12 | 0.028 | 0.006 | 19.12 | 1.88 | 1.93 | 0.33 | 0.008 | 0.006 | 0.010 | 21.0 | — | ⊙ | ○ | Example |
| 2 | 0.012 | 0.38 | 0.15 | 0.035 | 0.007 | 18.73 | 1.79 | 1.89 | 0.35 | 0.009 | 0.009 | 0.021 | 20.5 | — | ⊙ | ○ | Example |

TABLE 1-continued

| Steel No. | Chemical composition (mass %) C | Si | Mn | P | S | Cr | Mo | Ni | Nb | Al | N | C + N | Cr + Mo | Other elements | Corrosion Resistance to Condensed Water | Brazability | Note |
|---|---|---|---|---|---|---|---|---|---|---|---|---|---|---|---|---|---|
| 3 | 0.009 | 0.29 | 1.28 | 0.029 | 0.008 | 20.16 | 1.82 | 2.23 | 0.36 | 0.011 | 0.008 | 0.017 | 22.0 | — | ⊙ | ○ | Example |
| 4 | 0.011 | 0.35 | 0.13 | 0.031 | 0.009 | 17.30 | 1.69 | 2.41 | 0.31 | 0.012 | 0.006 | 0.017 | 19.0 | — | ⊙ | ○ | Example |
| 5 | 0.008 | 0.36 | 0.11 | 0.025 | 0.008 | 28.10 | 1.93 | 2.02 | 0.32 | 0.011 | 0.007 | 0.015 | 30.0 | — | ⊙ | ○ | Example |
| 6 | 0.006 | 0.31 | 0.22 | 0.032 | 0.004 | 19.36 | 1.13 | 1.98 | 0.33 | 0.009 | 0.009 | 0.015 | 20.5 | — | ⊙ | ○ | Example |
| 7 | 0.005 | 0.33 | 0.28 | 0.028 | 0.003 | 20.41 | 2.87 | 1.88 | 0.34 | 0.009 | 0.011 | 0.016 | 23.3 | — | ⊙ | ○ | Example |
| 8 | 0.009 | 0.28 | 0.13 | 0.036 | 0.006 | 21.22 | 2.01 | 0.82 | 0.36 | 0.011 | 0.004 | 0.013 | 23.2 | — | ○ | ○ | Example |
| 9 | 0.004 | 0.36 | 0.15 | 0.031 | 0.009 | 20.76 | 1.92 | 1.08 | 0.35 | 0.008 | 0.008 | 0.012 | 22.7 | — | ○ | ○ | Example |
| 10 | 0.008 | 0.36 | 0.18 | 0.028 | 0.009 | 18.93 | 1.81 | 2.93 | 0.31 | 0.007 | 0.009 | 0.017 | 20.7 | — | ⊙ | ○ | Example |
| 11 | 0.012 | 0.35 | 0.19 | 0.026 | 0.004 | 17.98 | 1.63 | 2.72 | 0.22 | 0.012 | 0.011 | 0.023 | 19.6 | — | ⊙ | ○ | Example |
| 12 | 0.008 | 0.33 | 0.12 | 0.025 | 0.007 | 20.34 | 1.93 | 1.45 | 0.79 | 0.014 | 0.007 | 0.015 | 22.3 | — | ⊙ | ○ | Example |
| 13 | 0.007 | 0.32 | 0.17 | 0.036 | 0.005 | 18.95 | 1.68 | 1.78 | 0.32 | 0.082 | 0.012 | 0.019 | 20.6 | — | ⊙ | ○ | Example |
| 14 | 0.011 | 0.16 | 0.21 | 0.037 | 0.006 | 20.61 | 1.73 | 1.21 | 0.34 | 0.013 | 0.017 | 0.028 | 22.3 | — | ⊙ | ○ | Example |
| 15 | 0.006 | 0.28 | 0.14 | 0.021 | 0.008 | 17.72 | 1.48 | 0.98 | 0.34 | 0.011 | 0.008 | 0.014 | 19.2 | — | ○ | ○ | Example |
| 16 | 0.005 | 0.37 | 0.11 | 0.031 | 0.005 | 20.47 | 1.91 | 1.78 | 0.36 | 0.005 | 0.007 | 0.012 | 22.4 | — | ⊙ | ○ | Example |
| 17 | 0.007 | 0.36 | 0.19 | 0.031 | 0.007 | 19.21 | 1.95 | 1.65 | 0.32 | 0.007 | 0.009 | 0.016 | 21.2 | Cu: 0.34 | ⊙ | ○ | Example |
| 18 | 0.006 | 0.32 | 0.16 | 0.030 | 0.003 | 20.66 | 1.95 | 1.88 | 0.41 | 0.007 | 0.007 | 0.013 | 22.6 | Co: 0.40 | ⊙ | ○ | Example |
| 19 | 0.011 | 0.34 | 0.13 | 0.028 | 0.006 | 18.92 | 1.88 | 1.12 | 0.33 | 0.013 | 0.005 | 0.016 | 20.8 | Ti: 0.08 | ○ | ○ | Example |
| 20 | 0.008 | 0.19 | 0.11 | 0.037 | 0.005 | 20.82 | 1.83 | 1.53 | 0.31 | 0.011 | 0.005 | 0.013 | 22.7 | V: 0.15 | ⊙ | ○ | Example |
| 21 | 0.009 | 0.31 | 0.15 | 0.029 | 0.007 | 21.22 | 1.79 | 1.08 | 0.32 | 0.012 | 0.006 | 0.015 | 23.0 | W: 0.12, Zr: 0.05, B: 0.0004 | ○ | ○ | Example |
| 22 | 0.005 | 0.28 | 0.16 | 0.031 | 0.008 | 17.98 | 1.92 | 1.23 | 0.33 | 0.009 | 0.004 | 0.009 | 19.9 | Cu: 0.07, Ca: 0.0007, REM: 0.018 | ⊙ | ○ | Example |

The balance other than the above components is Fe and incidental impurities.
Underlines indicate the outside of the scope of the present invention.

TABLE 2

| Steel No. | Chemical composition (mass %) C | Si | Mn | P | S | Cr | Mo | Ni | Nb | Al | N | C + N | Cr + Mo | Other elements | Corrosion Resistance to Condensed Water | Brazability | Note |
|---|---|---|---|---|---|---|---|---|---|---|---|---|---|---|---|---|---|
| 23 | 0.006 | 0.25 | 0.21 | 0.026 | 0.005 | 16.70 | 1.83 | 1.78 | 0.34 | 0.014 | 0.007 | 0.013 | 18.5 | — | X | ○ | Comparative Example |
| 24 | 0.004 | 0.26 | 0.18 | 0.032 | 0.006 | 19.33 | 1.04 | 1.09 | 0.33 | 0.007 | 0.007 | 0.011 | 20.4 | — | X | ○ | Comparative Example |
| 25 | 0.008 | 0.31 | 0.24 | 0.031 | 0.007 | 18.86 | 1.93 | 0.77 | 0.31 | 0.008 | 0.009 | 0.017 | 20.8 | — | X | ○ | Comparative Example |
| 26 | 0.007 | 0.24 | 0.17 | 0.028 | 0.004 | 19.78 | 1.95 | 1.78 | 0.18 | 0.014 | 0.008 | 0.015 | 21.7 | — | X | ○ | Comparative Example |
| 27 | 0.009 | 0.21 | 0.22 | 0.029 | 0.003 | 18.13 | 1.78 | 1.48 | 0.32 | 0.115 | 0.006 | 0.015 | 19.9 | — | ⊙ | X | Comparative Example |
| 28 | 0.015 | 0.18 | 0.15 | 0.024 | 0.006 | 20.25 | 1.98 | 0.98 | 0.31 | 0.008 | 0.017 | 0.032 | 22.2 | — | X | ○ | Comparative Example |
| 29 | 0.012 | 0.13 | 0.13 | 0.036 | 0.007 | 17.23 | 1.21 | 1.05 | 0.33 | 0.007 | 0.012 | 0.024 | 18.4 | — | X | ○ | Comparative Example |
| 30 | 0.007 | 0.23 | 0.14 | 0.033 | 0.008 | 19.12 | 1.71 | 1.89 | 0.34 | 0.013 | 0.009 | 0.016 | 20.8 | Ti: 0.13 | ⊙ | X | Comparative Example |
| 31 | 0.005 | 0.35 | 0.21 | 0.032 | 0.006 | 19.31 | 1.87 | 1.88 | 0.35 | 0.004 | 0.007 | 0.012 | 21.2 | — | ⊙ | ○ | Example |
| 32 | 0.006 | 0.39 | 0.15 | 0.034 | 0.007 | 18.80 | 1.98 | 1.52 | 0.33 | 0.005 | 0.008 | 0.014 | 20.8 | — | ⊙ | ○ | Example |
| 33 | 0.006 | 0.32 | 0.16 | 0.033 | 0.008 | 18.92 | 1.78 | 1.25 | 0.34 | 0.005 | 0.007 | 0.013 | 20.7 | — | ⊙ | ○ | Example |
| 34 | 0.007 | 0.38 | 0.18 | 0.035 | 0.006 | 19.45 | 1.63 | 1.83 | 0.33 | 0.003 | 0.009 | 0.016 | 21.1 | Co: 0.23, W: 0.21, V: 0.18 | ⊙ | ○ | Example |
| 35 | 0.005 | 0.36 | 0.17 | 0.032 | 0.005 | 18.68 | 1.82 | 1.78 | 0.35 | 0.004 | 0.008 | 0.013 | 20.5 | Cu: 0.38, Zr: 0.12 | ⊙ | ○ | Example |
| 36 | 0.006 | 0.28 | 0.13 | 0.031 | 0.007 | 25.63 | 1.67 | 1.46 | 0.32 | 0.006 | 0.007 | 0.013 | 27.3 | — | ⊙ | ○ | Example |
| 37 | 0.004 | 0.31 | 0.21 | 0.035 | 0.007 | 20.73 | 1.53 | 2.43 | 0.35 | 0.005 | 0.008 | 0.012 | 22.3 | — | ⊙ | ○ | Example |
| 38 | 0.005 | 0.34 | 0.15 | 0.032 | 0.006 | 19.55 | 2.73 | 1.73 | 0.31 | 0.007 | 0.008 | 0.013 | 22.3 | — | ⊙ | ○ | Example |
| 39 | 0.008 | 0.36 | 0.18 | 0.036 | 0.006 | 20.89 | 1.77 | 0.85 | 0.34 | 0.004 | 0.007 | 0.015 | 22.7 | Cu: 0.33 | ○ | ○ | Example |
| 40 | 0.005 | 0.35 | 0.16 | 0.033 | 0.005 | 18.97 | 1.82 | 1.93 | 0.23 | 0.005 | 0.006 | 0.011 | 20.8 | — | ⊙ | ○ | Example |
| 41 | 0.006 | 0.33 | 0.17 | 0.032 | 0.007 | 19.45 | 1.91 | 1.58 | 0.78 | 0.007 | 0.008 | 0.014 | 21.4 | V: 0.23 | ⊙ | ○ | Example |
| 42 | 0.013 | 0.38 | 0.22 | 0.034 | 0.006 | 18.69 | 1.83 | 1.26 | 0.34 | 0.006 | 0.013 | 0.026 | 20.5 | Ti: 0.04, Mg: 0.0004 | ⊙ | ○ | Example |

TABLE 2-continued

| Steel No. | Chemical composition (mass %) C | Si | Mn | P | S | Cr | Mo | Ni | Nb | Al | N | C + N | Cr + Mo | Other elements | Corrosion Resistance to Condensed Water | Brazability | Note |
|---|---|---|---|---|---|---|---|---|---|---|---|---|---|---|---|---|---|
| 43 | 0.008 | 0.31 | 0.16 | 0.033 | 0.007 | 17.43 | 1.78 | 1.68 | 0.33 | 0.005 | 0.008 | 0.016 | 19.2 | Cu: 0.21, Zr: 0.03 | ⊙ | ○ | Example |

The balance other than the above components is Fe and incidental impurities.
Underlines indicate the outside of the scope of the present invention.

Tables 1 and 2 indicate excellent corrosion resistance to condensed water and brazability for all the Example steel Nos. 1 to 22 and 31 to 43.

In particular, Steel Nos. 1 to 7, 10 to 14, 16 to 18, 20, 22, 31 to 38, and 40 to 43 each having Ni content of 1.20% or more are particularly excellent in corrosion resistance to condensed water.

In contrast, Steel Nos. 23, 24, 25, and 26 each having any of Cr, Mo, Ni, and Nb content that falls outside the range of the present invention, Steel No. 28 that fails to satisfy expression 1, and Steel No. 29 that fails to satisfy expression 2 are unsatisfactory in corrosion resistance to condensed water.

Moreover, Steel Nos. 27 and 30 each having either Al or Ti content that falls outside the range of the present invention are unsatisfactory in brazability.

INDUSTRIAL APPLICABILITY

The ferritic stainless steel according to aspects of the present invention is suitable for members used for an exhaust heat recovery device and an exhaust gas recirculation device, such as an EGR cooler, that are exposed to condensed water generated from automobile exhaust gas.

The invention claimed is:

1. A ferritic stainless steel having a composition containing, in mass %,

C: 0.025% or less,
Si: 0.30% or more and less than 0.40%,
Mn: 0.05 to 1.5%,
P: 0.05% or less,
S: 0.01% or less,
Cr: 17.0 to 30.0%,
Mo: 1.10 to 3.0%,
Ni: 1.20% or more and 3.0% or less,
Nb: 0.20 to 0.80%,
Al: 0.001 to 0.015%,
N: 0.025% or less,
Ti: 0.01 to 0.10%, and
optionally W: 0.01 to 1.0% with the balance being Fe and incidental impurities, and satisfying the following expression (1) and expression (2):

$C+N \leq 0.030\%$ (1)

$Cr+Mo \geq 19.0\%$ (2)

where C, N, Cr, and Mo in expression (1) and expression (2) represent the contents, in mass % of the corresponding elements, wherein a permeation of a brazing material is 50% or more of an overlapped length of two sheets using the ferritic stainless steel after applying 1.2 g of BNi 5 brazing material, having a composition of Ni-19Cr-10Si, to the end face of either of overlapped two steel sheets and brazing the steel sheets in a vacuum atmosphere of $10^{-2}$ Pa under heating conditions of 1,170° C. ×600 s, and wherein a maximum corrosion depth is less than 100 μm after four cycles, of condensed water corrosion test, of all of: full immersion of a specimen of the ferritic stainless steel in a 200 ppm $Cl^-$+600 ppm $SO_4^{2-}$ solution with pH 8.0 and holding at 80° C. for 24 hours for immersion/evaporation tests; and holding in a furnace at 250° C. for 24 hours.

2. The ferritic stainless steel according to claim 1, further containing, in mass %, one or two selected from Cu: 0.01 to 1.0%, and
Co: 0.01 to 1.0%.

3. The ferritic stainless steel according to claim 2, further containing, in mass %, one or two or more selected from V: 0.01 to 0.50%,
Zr: 0.01 to 0.30%,
B: 0.0003 to 0.005%,
Ca: 0.0003 to 0.003%,
Mg: 0.0003 to 0.003%, and
REM: 0.001 to 0.10%.

4. The ferritic stainless steel according to claim 3, wherein the ferritic stainless steel is used for an automotive exhaust heat recovery device or exhaust gas recirculation device.

5. The ferritic stainless steel according to claim 2, wherein the ferritic stainless steel is used for an automotive exhaust heat recovery device or exhaust gas recirculation device.

6. The ferritic stainless steel according to claim 1, further containing, in mass %, one or two or more selected from V: 0.01 to 0.50%,
Zr: 0.01 to 0.30%,
B: 0.0003 to 0.005%,
Ca: 0.0003 to 0.003%,
Mg: 0.0003 to 0.003%, and
REM: 0.001 to 0.10%.

7. The ferritic stainless steel according to claim 6, wherein the ferritic stainless steel is used for an automotive exhaust heat recovery device or exhaust gas recirculation device.

8. The ferritic stainless steel according to claim 1, wherein the ferritic stainless steel is used for an automotive exhaust heat recovery device or exhaust gas recirculation device.

9. A ferritic stainless steel having a composition consisting of, in mass %, C: 0.025% or less,
Si: 0.30% or more and less than 0.40%,
Mn: 0.05 to 1.5%,
P: 0.05% or less,
S: 0.01% or less,
Cr: 17.0 to 30.0%,
Mo: 1.10 to 3.0%,
Ni: 1.20% or more and 3.0% or less,
Nb: 0.20 to 0.80%, Al: 0.001 to 0.015%,
N: 0.025% or less, and
Ti: 0.01 to 0.10%,
optionally one or more selected from
W: 0.01 to 1.0%,
Cu: 0.01 to 1.0%,
Co: 0.01 to 1.0%,
V: 0.01 to 0.50%,
Zr: 0.01 to 0.30%,
B: 0.0003 to 0.005%,
Ca: 0.0003 to 0.003%,
Mg: 0.0003 to 0.003%,
REM: 0.001 to 0.10%
with the balance being Fe and incidental impurities, and satisfying the following expression (1) and expression (2):
$C+N \leq 0.030\%$ (1)
$Cr+Mo \geq 19.0\%$ (2)
where C, N, Cr, and Mo in expression (1) and expression (2) represent the contents, in mass % of the corresponding elements, wherein a permeation of a brazing material is 50% or more of an overlapped length of two sheets using the ferritic stainless steel after applying 1.2 g of BNi-5 brazing material, having a composition of Ni-19Cr-10Si, to the end face of either of overlapped two steel sheets and brazing the steel sheets in a vacuum atmosphere of $10^{-2}$ Pa under heating conditions of 1,170° C. ×600 s, and wherein a maximum corrosion depth is less than 100 μm after four cycles, of condensed water corrosion test, of all of: full immersion of a specimen of the ferritic stainless steel in a 200 ppm $Cl^-$+600 ppm $SO_4^{2-}$ solution with pH 8.0 and holding at 80° C. for 24 hours for immersion/evaporation tests; and holding in a furnace at 250° C. for 24 hours.

10. The ferritic stainless steel according to claim 9, wherein the ferritic stainless steel is used for an automotive exhaust heat recovery device or exhaust gas recirculation device.

* * * * *